US005083500A

United States Patent [19]

Francis et al.

[11] Patent Number: 5,083,500

[45] Date of Patent: * Jan. 28, 1992

[54] RADON TREATMENT SYSTEM AND METHOD

[75] Inventors: Thomas Francis, Fraser; K. Rand Dykman, Armada, both of Mich.

[73] Assignee: Superior Environmental Services, Inc., Armada, Mich.

[ * ] Notice: The portion of the term of this patent subsequent to Jul. 18, 2006 has been disclaimed.

[21] Appl. No.: 361,392

[22] Filed: Jun. 5, 1989

Related U.S. Application Data

[60] Continuation-in-part of Ser. No. 335,878, Apr. 10, 1989, Pat. No. 4,981,150, which is a division of Ser. No. 182,178, Apr. 15, 1988, Pat. No. 4,848,380.

[51] Int. Cl.[5] ..... F24F 11/00

[52] U.S. Cl. ..... 454/341; 52/169.5; 454/345; 454/909

[58] Field of Search ..... 98/1.5, 42.02, 42.06, 98/42.07, 122; 210/767; 52/169.5, 742; 405/43; 134/8, 24, 26, 25.1, 25.4, 22.12, 22.18

[56] References Cited

U.S. PATENT DOCUMENTS

| | | | |
|---|---|---|---|
| 2,235,663 | 3/1941 | Backmann | 98/122 |
| 2,768,949 | 10/1956 | Hewey | 210/6 |
| 3,007,186 | 11/1961 | Olsson | 15/104.3 |
| 3,321,184 | 5/1967 | Goss | 134/167 C |
| 3,370,599 | 2/1968 | Ciaccio | 134/167 C |
| 3,535,161 | 10/1970 | Gutrich | 134/24 |
| 3,658,589 | 4/1972 | Shaddock | 134/10 |
| 3,814,330 | 6/1974 | Masters | 239/558 |
| 4,073,302 | 2/1978 | Jones | 134/167 C |
| 4,136,500 | 1/1979 | Di Fiore | 52/742 |
| 4,391,551 | 7/1983 | Belcher | 405/43 |
| 4,620,817 | 11/1986 | Cushing | 405/43 |
| 4,756,324 | 7/1988 | Larsson | 134/167 C |
| 4,773,113 | 9/1988 | Russell | 15/4 |
| 4,798,034 | 1/1989 | Jarnagin et al. | 52/169.5 |
| 4,838,768 | 6/1989 | Flaherty | 417/308 |
| 4,898,197 | 2/1990 | Barry et al. | 134/22.12 X |
| 4,923,331 | 5/1990 | Kreikemeier | 405/45 |
| 4,938,124 | 7/1990 | Garza | 98/42.06 X |

FOREIGN PATENT DOCUMENTS

| | | | |
|---|---|---|---|
| 564489 | 10/1958 | Canada | 134/167 C |

OTHER PUBLICATIONS

"Radon Reduction Techniques for Detached Houses", *Technical Guidance*, EPA/625/5-86/019, U.S. Environmental Protection Agency, Jun. 1986.

Application of Radon Reduction Methods EPA/625-/5-88/024 Aug. 1988 (EPA).

Halliburton's Line Mole Cleaning Process . . . Chemical Engineering (10/23/67), p. 89.

*Primary Examiner*—Harold Joyce

*Attorney, Agent, or Firm*—Gerald R. Black

[57] ABSTRACT

The system for removing the soil gas from the ground surrounding the building structure, includes a clean-out pipe, an air duct system, and a fan. The clean-out pipes are installed inside the building structure, accessible from the ground level and near junctions between the interconnecting pipes and the drain tile. The air duct system is securable to a clean-out pipe, and the fan is installed inside the air duct system. The air duct system is disconnected from the clean-out pipe during the cleaning of the drain tile system. The pressurized fluid projecting through the tip of the rocket nozzle, removes any obstructions in the drain tile, and the pressurized fluid projecting rearward from the nozzle, propels the rocket nozzle through the drain tile system. The air duct system is then connected to the clean-out pipe. The venting of air away from the drain tile system creates a negative pressure, which draws the soil gas into the porous drain tile. By continuously operating the fan, venting the air in the drain tile the soil gas is effectively prevented from entering the building structure.

18 Claims, 2 Drawing Sheets

60
50
46
49
48
18
44
14
66
10
64
88
88
22

RADON TREATMENT SYSTEM AND METHOD

CROSS-REFERENCE TO RELATED APPLICATIONS

This is a continuation-in-part of copending U.S. patent application Ser. No. 07/335,878 filed on Apr. 10th, 1989, now U.S. Pat. No. 4,981,150, and which is a division of U.S. patent application Ser. No. 07/182,178, filed on Apr. 15th, 1988, now U.S. Pat. No. 4,848,380 the disclosures of which are hereby incorporated by allowance.

BACKGROUND OF THE INVENTION

1. Field of the Invention

The present invention relates to a new system and method for removing soil gas from in a safe and effective manner from the ground surrounding a building structure.

2. Background Art

Radon is an invisible, odorless, tasteless radioactive gas produced by the natural decay of uranium in the soil. The Center for Disease Control in Atlanta, Georgia has reported that human exposure to radon gas is the primary cause of lung cancer, except for cigarettes. Such human exposure routinely occurs from radon gas that seeps from the ground into dwellings and other building structures. Scientists estimate that 20,000 Americans die annually as a result of radon exposure.

In a recent study completed by the Environmental Protection Agency (1988) in a seven state area, it was found that one home in three had dangerous levels of radon gas. The EPA has set a recommended level for remedial action at 4 picocuries per liter, which is equivalent to 200 chest x-rays per year. Even at this level studies have indicated that almost 5 people out of 100 exposed to high levels of radon will die of radon-induced lung cancer.

Conventional dwellings and other building structures are typically built upon foundation walls which define the basement area. The foundation walls and the footers are in direct contact with the ground surrounding the building structure. Most such building structures have an existing drain tile system in the immediate proximity of the foundation, which enables water and debris immediately surrounding the building structure to drain away therefrom. The drain tile system is generally located within a bed of water-permable material such as gravel, the gravel bed surrounding the building structure.

The drain tile system is generally located around the perimeter of the building structure slightly below the foundation, either directly under the perimeter of the building structure or surrounding the perimeter of the building structure. The drain tile system is made of a water porous tile and is laid in a continuous channel, so that water and contaminants disposed in the vicinity of the building structure can be routed across and through the drain tile system and into a sewer or a sump pump. The drain tile system is generally in fluid communication with a series of interconnecting pipes disposed underneath the building structure. Generally, these interconnecting pipes have gradual bends in the direction of fluid flow and are accessible through several floor drains located in the basement floor of the building structure. The drain tile system feeds into either a sump pump or a centralized sewer.

Soil ventilation draws soil gas away from the building structure. The suction of soil gas through the drain tile system is enhanced by a fan which suctions the soil gas from the soil around the foundation and through the drain tile system and away from the building structure, effectively preventing the soil gas from entering the building structure. Drain tile suction is an inexpensive and nonobtrusive method of active soil ventilation, and such systems have demonstrated reductions in radon gas as high as 99%.

For drain tile suction to be effective, it is critical that the drain tile system must be maintained free from objects which tend to block the normal flow of water therethrough and prevent ventilation of the drain tile system.

Oftentimes, the drain tile system is interconnected to the eaves wherein leaves and twigs, roof tar, and even the remains of small animals may become lodged therein. Since the flow of water and debris through the drain tile is at most a trickle, the drain tile is never flushed. When the drain tile becomes blocked at various locations with debris, as frequently occurs, the drain tile system is extremely difficult to clean. The property owner is confronted with choosing between:

(a) digging several feet deep into all the land surrounding the building structure to access the existing drain tile system, and to locate and remove the blockages; or (b) inserting a second drain tile system underneath the building structure, and thereby jackhammering major portions of the existing basement floor.

What is needed is a new method and apparatus for cleaning the existing drain tile that overcomes the disadvantages already noted; a method and system which combines the continuous soil ventilation through the drain tile system to remove soil gas from the vicinity of a building structure with a new method and system for keeping the drain tile system free from blockages.

SUMMARY OF THE INVENTION

Thomas Francis and K. Rand Dykman have invented a new method of cleaning drain tile systems by using a rocket nozzle attached to a flexible tubing, with highly pressurized water (preferably 2200 to 5200 psi) propelling the rocket nozzle through the drain tile system, and removing blockages and other debris therefrom. This method for cleaning drain tile systems is fully disclosed in U.S. patent application Ser. No. 07/182,178, entitled "Foundation Drain Cleaning Apparatus and Method", filed on Apr. 15th, 1988 now U.S. Pat. No. 4,848,380.

This invention enables blockages and debris to be effectively removed from the existing drain tile, while not damaging the landscape around the building structure, the basement floor, or the drain tile. This enables the hidden drain tile system to be located, and involves the construction of an accessing system that can be permanently used as thereafter needed. The system accesses the drain tile system at several discrete locations, clearing blockages from anywhere in the drain tile system, and cleaning the inside surface of the drain tile system so that soil gas can be continuously ventilated therethrough.

The present invention effectively enables soil gas to be removed from the ground surrounding a building structure. The system includes a clean-out pipe, an air duct system, and a fan. One or more clean-out pipes are disposed near the junctions between the interconnecting pipes and the drain tile system, the interconnecting pipes being disposed underneath the building structure. Preferably, the clean-out pipes are disposed inside the building structure, and are accessible from the ground level. The air duct system is in fluid communication with the clean-out pipe. The air duct system is vented to atmosphere outside the building structure. The air duct system is secureable to a clean-out pipe, and the fan is installed, preferably inside the air duct system. The fan enables air from the drain tile system to be vented through the clean-out pipe, through the air duct system, and to atmosphere surrounding the building structure.

The position of the junctions between the interconnecting pipe and the drain tile system are preferably located by inserting a rocket nozzle into a centralized drain in the basement floor. The rocket nozzle is propelled through the interconnecting pipes, and the nozzle will stop at the junction between the interconnecting pipe and the drain tile. The position of the rocket nozzle is located through the floor of the basement by the sound that the fluid makes as it escapes from the nozzle. The clean-out pipes are then inserted into the basement floor by digging through the basement floor in the vicinity of the junction.

The air duct system is preferably disconnected from the clean-out pipe during the cleaning of the drain tile system. The pressurized fluid projecting through the tip of the rocket nozzle, removes any obstructions in the drain tile, and the pressurized fluid projecting rearward from the nozzle, propels the rocket nozzle through the drain tile in a forward direction and washes the debris through the drain tile system.

After the debris has been cleaned from the drain tile system, the air duct system is reconnected to the system and the fan is energized. A negative pressure in the clean drain tile system draws the soil gas surrounding the drain tile system into the porous drain tile. By continuously operating the fan, the air in the drain tile system is vented through the air duct system and to atmosphere above the building structure. Hence, the soil gas is effectively prevented from entering the building structure.

For a more complete understanding of the radon treatment system and method of the present invention, reference is made to the following detailed description and accompanying drawings in which the presently preferred embodiments of the invention are illustrated by way of example. As the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 3:
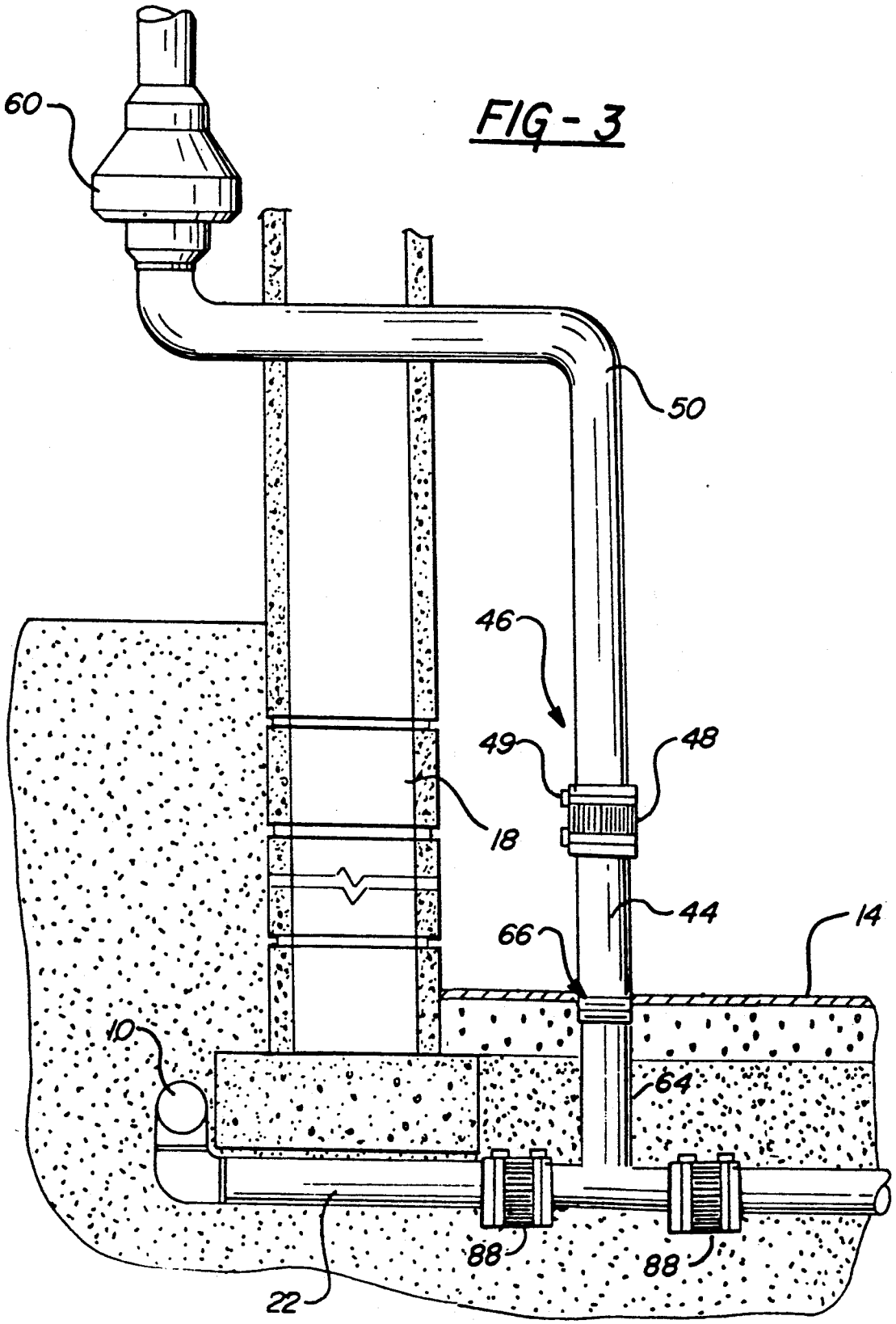
FIG. 3 is an enlarged cross-sectional view of the air duct system and fan, the air duct system being engaged with the clean-out pipe.

Referring now to the drawings, the system 66 for removing the soil gas from the ground surrounding the building structure 12, includes a clean-out pipe 64, an air duct system 46, and a fan 60, which are installed in conjunction with an existing drain tile system 10 (see FIG. 3).

The water porous drain tile system 10 will not effectively remove the soil gas from the ground surrounding the building structure 12 if:

(a) there are one or more blockages in the drain tile system 10 which prevent a portion of the drain tile system 10 from venting through the clean-out pipe 64 and the air duct system 46; or (b) debris is allowed to build up along the inside surface of the drain tile system 10 preventing the soil gas to be drawn into the drain tile system 10 by the negative pressure of the fan 60.

Accordingly, regular cleaning and maintenance of the complete drain tile system 10 is required if the soil gas is to be vented through the drain tile system 10.

Figure 1:
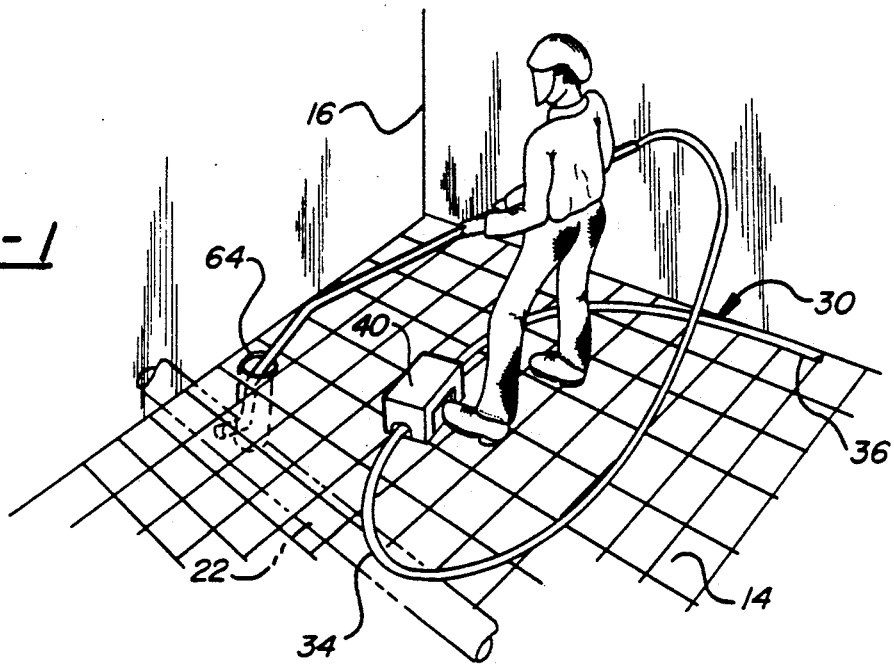
FIG. 1 is a perspective view of an operating using a high pressurized fluid system to clean the foundation drain tile system.

The drain tile system 10 may be cleaned and maintained by highly pressurized water being projected through a rocket nozzle 32 which is in fluid communication with a flexible tubing 30 (see FIG. 1). The head portion of the rocket nozzle 32 preferably has an opening on the tip thereof through which the pressurized water is dischargeable in the forward direction. The tail portion of the rocket nozzle 32 is in fluid communication with a high pressure water supply. The rocket nozzle 32 has a recess between the head portion and tail portion, the recess having a rearward surface. At least two apertures are disposed along the recess. The water escaping through the apertures in the recess propel the rocket nozzle 32 in a forward direction.

Figure 2:
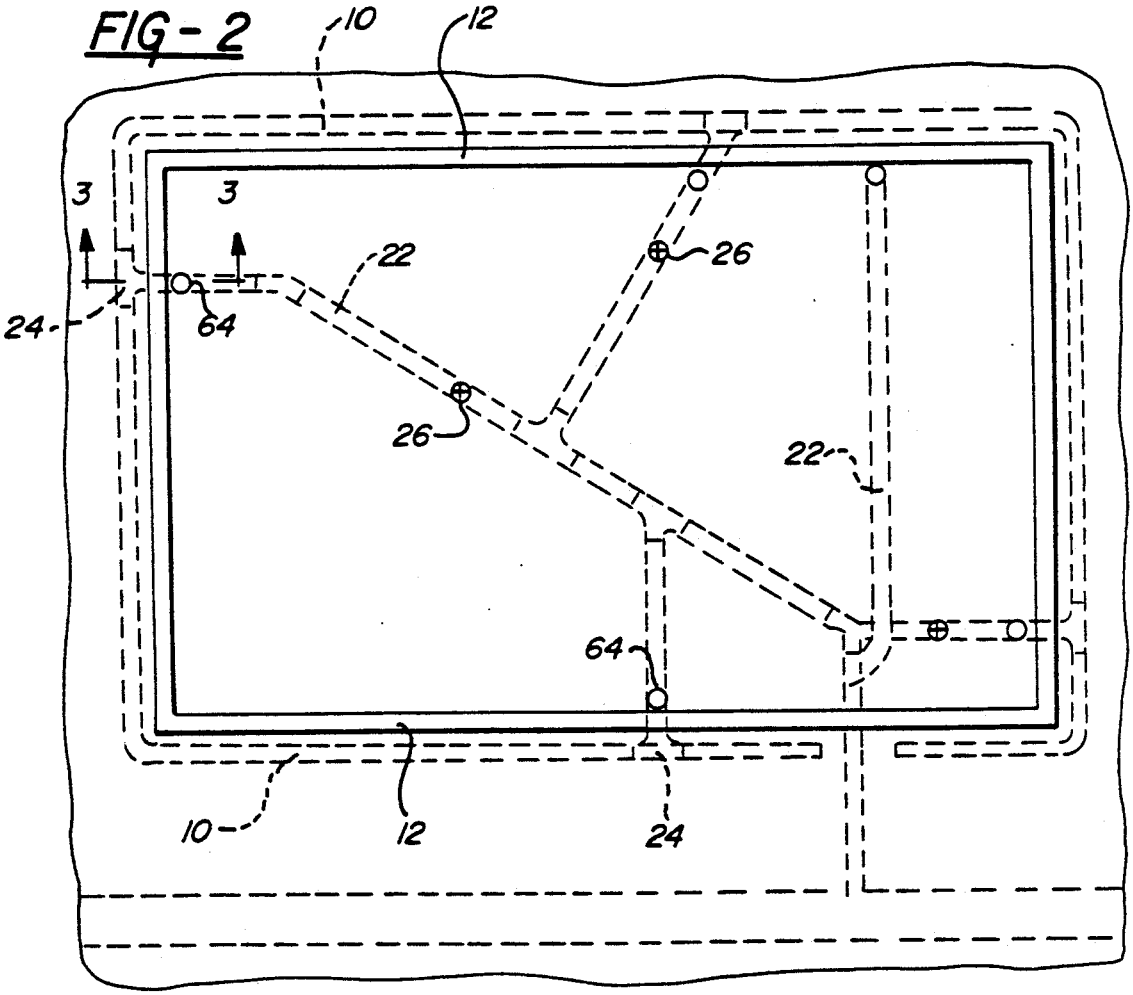
FIG. 2 is a plan view of a drain tile system located around the perimeter of a building structure.

As shown in FIG. 2, the cleanout pipes 64 are disposed proximate to the junctions 24 between the interconnecting pipes 22 and the drain tile system 10. Each clean-out pipe 64 is preferably four inch Schedule 40 pipe, and is in fluid communication with both the drain tile system 10 and an interconnecting pipe 22. Preferably, a clean-out pipe 64 is installed at each junction between the interconnecting pipe 22 and the drain tile system 10, the clean-out pipes 64 being disposed inside the building structure 12, and accessible from the ground level. To remove the blockages from the drain tile system 10, the rocket nozzle 32 is preferably inserted into the drain tile system 10 through the clean-out pipes 64.

The position of each junction 24 must be located before the clean-out pipes 64 can be installed. One way of locating the junctions 24 is by inserting a snake into a floor drain and through the interconnecting pipe. However, the junctions 24 are preferably located by inserting the rocket nozzle 32 into a centralized drain 26 in the basement floor 14. The pressurized water propels the rocket nozzle 32 through the interconnecting pipes 22. The rocket nozzle 32 will stop at a junction 24, since the rocket nozzle 32 cannot ordinarily overcome the radical bends that generally exist between the interconnecting pipe 22 and the drain tile system 10. The position of the rocket nozzle 32 is located through the floor 14 of the building structure by the sound that the water escaping from the rocket nozzle 32. Once the position of the junctions 24 are located, clean-out pipes 64 are installed into the basement floor 14 in the vicinity of each junction 24. A hole is made in the floor of the building structure 12 at the location for the clean-out pipe 64, and a portion of the interconnecting pipe 22 is removed. A clean-out tee 64 is inserted therein, and a boot 88 with two stainless steel clamps is placed around both ends were the clean-out tee 64 meets the interconnecting pipe 22. The stem of the clean-out pipe 64 extends into the floor of the building structure 12, and is preferably threaded so that it may be capped when not in use.

The flexible tubing 36 and the tube fittings are capable of withstanding the flow of high pressure water. A conventional pump (not shown) is connected to the tap water to raise the supply pressure of the water from 2200 to 5200 psi. Water flows through the rocket nozzle 32 at a rate of about 4.5 gallons per minute. A foot pedal control valve 40 is used to start and stop the water flow into the tubing 36 and the rocket nozzle 32. The control valve 40 has a spring-actuated lever which is actuated by the foot of the operator. When water is flowing through the system, actuation of the control valve 40 will terminate the water flow to the rocket nozzle 32.

As pressurized water is supplied to the rocket nozzle 32, the water is projected through the apertures, propelling the rocket nozzle 32 in a forward direction through the drain tile system 10. As the rocket nozzle 32 is propelled through the drain tile system 10, the pressurized water flowing through the tip of the rocket nozzle 32 is continually directed at the debris with sufficient force to clear blockages in the drain tile system 10. The flow of the pressurized water rearwardly through the rocket nozzle 32 serves to: (1) propel the rocket nozzle 32 through the drain tile system 10; (2) separate the debris from the drain tile system 10; and (3) wash the debris through the drain tile system 10 and into either a sump pump or a central sewer.

The air duct system 46 as described herein preferably includes a duct segment 44, a primary duct 50, and a boot 48 and two stainless steel clamps 49 (see FIG. 3). The air duct system 46 is mounted and attached to one of the clean-out pipes 64 as shown in FIG. 3. The duct segment 44 is preferably PVC, Schedule 40 piping that is about four inches long. The air duct boot 48 and the pipe boots 88 are preferably Fernco rubber couplings. By placing the air duct system 46 in fluid communication with the drain tile system 10, air from inside the drain tile system 10 can be circulated into and through the air duct. The duct segment 44, the boot 48, and the clamps 49 can be quickly and readily disconnected from the clean-out pipe 64, enabling the rocket nozzle 32 to be inserted therein during the cleaning and maintaining of the drain tile system 10. The air duct system 46 is vented to the air outside, and preferably above the building structure 12.

The top end portions of all of the clean-out pipes 64 are preferably threaded, so that a pipe cap (not shown) may be inserted therein when the drain tile system 10 is not being cleaned. The pipe caps are preferably generally flush with the floor of the building structure 12. The clean-out pipe 64 that is to be connected to the air duct system 46 is threadably engaged with the duct segment 44. The rubber boot 48 is subsequently clamped over the top portion of the duct segment 44 and the primary duct 50, to prevent the soil gas from leaking into the building structure 12, during the continuously venting of the drain tile system 10. When the drain tile system 10 is to be periodically flushed and cleaned by means of the rocket nozzle/high pressure water, the clamps 49 are removed, the duct segment 44 is unthreaded from the clean-out pipe 64, and the rocket nozzle 32 is inserted into the clean-out pipe 64.

The fan 60 is disposed above the ground level. The fan 60 is disposed proximate to the primary duct 50, and preferably in the primary duct 50 and near the drain tile system 10 about two feet from the basement floor 14. The fan 60 enables the soil gas to be drawn into the porous drain tile system 10, and to circulate into and through the clean-out pipe 64, and the air duct system 46, where it is vented to the atmosphere over the building structure 12.

The cleaning and the flushing of debris from the drain tile system 10 creates a negative pressure in the drain tile system 10. This negative pressure draws the soil gas in the ground surrounding the drain tile system 10 to seep into the porous drain tile. By continuously venting the air in the drain tile system 10 through the air duct system 46 and to atmosphere above the building structure 12, any contaminants in the ground air surrounding the drain tile system 10 are effectively removed therefrom.

While the radon treatment method and system have been described in conjunction with a specific embodiment, it is evident that many alternatives, modifications, and variations will be apparent to those skilled in the art in light of the disclosure herein. It is intended that the metes and bounds of the invention be determined by the appended claims rather than by the language of the above specification, and that all such alternatives, modifications, and variations which form a functional or conjointly cooperative equivalent are intended to be included within the spirit and scope of these claims.

We claim:

1. A system for removing soil gas from the ground proximate to a building structure through a drain tile system, the drain tile system being disposed about the perimeter of the building structure beneath the surface, the drain tile system being in fluid communication with interconnecting pipes, the interconnecting pipes being disposed underneath the building structure, a plurality of junctions being disposed between the drain tile system and the interconnecting pipes, the system comprising:

(a) a clean-out pipe being disposed inside the building structure proximate to a junction, the clean-out pipe being in fluid communication with and connected to the drain tile system and the interconnecting pipes;

(b) an air duct system, the air duct system being in fluid communication with and connected to the clean-out pipe, the air duct system being vented to atmosphere outside the building structure; and (c) a fan being disposed above the ground level, the fan being disposed proximate to the air duct system, the fan enabling the soil gas that seeps into the drain tile system to circulate through the clean-out pipe, and into and through the air duct system.

2. The system of claim 1, wherein the air duct system includes quick disconnect means from the clean-out pipe.

3. The system of claim 1, wherein the clean-out pipe is affixable to one of the interconnecting pipes.

4. The system of claim 1, wherein the drain tile system is disposed directly under the perimeter of the building structure.

5. A method for installing a system to remove soil gas from the ground proximate to a building structure through a drain tile system, the drain tile system being disposed beneath the ground about the perimeter of a building structure, the drain tile system being in fluid communication with a plurality of interconnecting pipes, the interconnecting pipes being disposed underneath the building structure, the method comprising:

(a) attaching an air duct system to a clean-out pipe, the air duct system being in fluid communication with the drain tile system, the clean-out pipe being positioned inside the building structure proximate to a junction between one of the interconnecting pipes and the drain tile system, the attachment between the air duct system and the drain tile system being essentially air tight, the air duct system being vented to the air outside the building structure; and (b) disposing a fan proximate to the air duct system, the fan enabling the soil gas that seeps into the drain tile system to be circulated through the clean-out pipe, into and through the air duct system and vented to outside the building structure.

6. The method of claim 5, further comprising: affixing the clean-out pipe to one of the interconnecting pipes prior to the attachment of the air duct system.

7. The method of claim 6, further comprising: determining the position of a junction between one of the interconnecting pipes and the drain tile system prior to the installation of the clean-out pipe.

8. The method of claim 7, wherein the position of the junction is determined by inserting a rocket nozzle into a drain in the floor of the building structure, the rocket being in fluid communication with a high pressure fluid supply line, and locating the position of the rocket nozzle through the floor of the building structure by the sound of the fluid escaping from the nozzle.

9. The method of claim 5, wherein the air duct system includes quick disconnect means from the clean-out pipe.

10. The method of claim 6, wherein the clean-out pipe is accessible from the floor of the building structure.

11. A method for removing soil gas from the ground proximate to a building structure through a drain tile system, the drain tile system being disposed beneath the ground about the perimeter of a building structure, the drain tile system being in fluid communication with a plurality of interconnecting pipes, the interconnecting pipes being disposed underneath the building structure, the method comprising:

(a) inserting a rocket nozzle into the drain tile system through a clean-out pipe, the clean-out pipe being disposed proximate to a junction of the interconnecting pipe and the drain tile system inside the building structure, the clean-out pipe being in fluid communication with the interconnecting pipe and the drain tile system, the rocket nozzle being in fluid communication with a supply of highly pressurized fluid;

(b) propelling the rocket nozzle through the drain tile system in a forward direction by means of the highly pressurized fluid which escapes from the rocket nozzle in a rearward direction, the highly pressurized fluid separating the debris from the drain tile and flushing the debris through the drain tile system;

(c) drawing the soil gas into and through the drain tile system by creating a negative pressure in the drain tile system: and (d) venting the soil gas to the atmosphere surrounding the building structure.

12. The method of claim 11, wherein the soil gas is drawn into and through the drain tile system by a fan which is disposed proximate to an air duct system, the air duct system being attached to the clean-out pipe, the air duct system being in fluid communication with the drain tile system, the air duct system being vented to the air outside the building structure.

13. The method of claim 12, wherein the air duct system includes quick disconnect means from the clean-out pipe.

14. The vent system of claim 13, wherein the connecting means is a plurality of threads which are engageable with a plurality of threads disposed inside the top of the clean-out pipe.

15. A method for removing soil gas from the ground proximate to a building structure through a drain tile system, the drain tile system being disposed beneath the ground about the perimeter of a building structure, the drain tile system being in fluid communication with a plurality of interconnecting pipes, the interconnecting pipes being disposed underneath the building structure, the method comprising:

(a) inserting a rocket nozzle into the drain tile system through a clean-out pipe, the clean-out pipe being disposed inside the building structure and proximate to a junction of the interconnecting pipe and the drain tile system, the clean-out pipe being in fluid communication with the interconnecting pipe and the drain tile system, the rocket nozzle being in fluid communication with a supply of highly pressurized fluid;

(b) propelling the rocket nozzle through the drain tile system in a forward direction by means of the highly pressurized fluid which escapes from the rocket nozzle in a rearward direction, the highly pressurized fluid separating the debris from the drain tile and flushing the debris through the drain tile system;

(c) drawing the soil gas into and through the drain tile system by creating a negative pressure in the drain tile system: and (d) venting the soil gas to the atmosphere surrounding the building structure.

16. A vent system for readily engaging and disengaging a primary air duct from a drain tile system, the drain tile system being disposed about the perimeter of the building structure beneath the surface, the drain tile system being in fluid communication with interconnecting pipes disposed underneath the building structure, a plurality of junctions being located where the interconnecting pipes intersect the drain tile system. the disconnect means comprising:

(a) an air duct segment;

(b) means for directly engaging a first end of the air duct segment to a primary air duct, the engaging means being substantially air-tight, the primary air duct being vented to atmosphere outside the building structure; and (c) means for connecting a second end of the air duct segment to a clean-out pipe, the connecting means being substantially air-tight, the clean-out pipe being disposed proximate to a junction and inside the building structure, the clean-out pipe being in fluid communication with the drain tile system and the interconnecting pipes.

17. The vent system of claim 16, wherein the engagement means is a boot which wraps around the duct segment and the primary air duct, the boot being clamped in a secure manner to both the duct segment and the primary air duct.

18. The vent system of claim 16, wherein the drain tile system is disposed directly under the building structure.

* * * * *